US008308845B2

(12) United States Patent
Kandiyeli et al.

(10) Patent No.: US 8,308,845 B2
(45) Date of Patent: Nov. 13, 2012

(54) SYSTEM AND METHOD FOR PROCESSING HIGH PURITY MATERIALS

(75) Inventors: David Kandiyeli, Mesa, AZ (US); Todd Graves, Winder, GA (US); Rhey Yang, Jhubei (TW)

(73) Assignee: Mega Fluid Systems, Inc., Tualatin, OR (US)

( * ) Notice: Subject to any disclaimer, the term of this patent is extended or adjusted under 35 U.S.C. 154(b) by 184 days.

(21) Appl. No.: 12/857,828

(22) Filed: Aug. 17, 2010

(65) Prior Publication Data

US 2010/0307602 A1 Dec. 9, 2010

Related U.S. Application Data

(63) Continuation of application No. 11/778,806, filed on Jul. 17, 2007, now Pat. No. 7,799,115.

(60) Provisional application No. 60/831,357, filed on Jul. 17, 2006.

(51) Int. Cl.
*B01D 50/00* (2006.01)

(52) U.S. Cl. ..... 95/1; 95/21; 95/278; 55/283; 96/417; 96/421

(58) Field of Classification Search ..... 95/1, 21, 95/278, 279, 280; 55/283, 284, 286, 302; 96/417, 421

See application file for complete search history.

(56) References Cited

U.S. PATENT DOCUMENTS

| | | | |
|---|---|---|---|
| 4,923,068 | A | 5/1990 | Crowson |
| 6,406,364 | B1 | 6/2002 | Kimura et al. |
| 6,471,750 | B1 | 10/2002 | Olander |
| 6,540,819 | B2 | 4/2003 | Tom et al. |
| 6,874,929 | B2 | 4/2005 | Hiraoka |
| 6,955,198 | B2 | 10/2005 | Wodjenski |
| 6,997,202 | B2 | 2/2006 | Olander |
| 7,007,822 | B2 | 3/2006 | Forshey et al. |
| 7,018,448 | B2 | 3/2006 | Wodjenski et al. |
| 7,040,967 | B2 | 5/2006 | Benner |
| 7,051,749 | B2 | 5/2006 | Wodjenski et al. |
| 7,104,292 | B2 | 9/2006 | Wodjenski |
| 7,208,417 | B2 | 4/2007 | Hiraoka |
| 7,284,564 | B2 | 10/2007 | Olander |
| 7,708,880 | B2 | 5/2010 | Yajima |
| 2001/0047821 | A1 | 12/2001 | Noji |
| 2008/0011661 | A1 | 1/2008 | Kandiyeli et al. |
| 2008/0012157 | A1 | 1/2008 | Kandiyeli et al. |

FOREIGN PATENT DOCUMENTS

| | | |
|---|---|---|
| KR | 20010110106 | 12/2001 |
| KR | 100523261 | 10/2005 |
| WO | 2004113023 | 12/2004 |

*Primary Examiner* — Robert A Hopkins
(74) *Attorney, Agent, or Firm* — Heslin Rothenberg Farley & Mesiti P.C.

(57) ABSTRACT

Systems and methods for processing high purity materials are disclosed. A unit operation processes a material stream, an operational parameter of the unit operation is monitored, and a standby unit is charged with pressurized gas to achieve system pressure. The material stream is diverted to the standby unit in response to the operational parameter of the unit operation registering a threshold value. Flow exiting the standby unit is first vented via an outlet, and then directed toward a point of use after the pressurized gas has been purged. The unit operation may then be serviced and subsequently brought back online. A second unit operation may process a second material stream simultaneously, and the second material stream may be periodically diverted to the standby unit in like manner, thus reducing line pressure variation. The disclosed method may be performed manually or implemented automatically through use of a controller.

65 Claims, 7 Drawing Sheets

SYSTEM AND METHOD FOR PROCESSING HIGH PURITY MATERIALS

RELATED APPLICATIONS

This application is a Continuation Application of U.S. application Ser. No. 11/778,806, filed Jul. 17, 2007, which claims priority under 35 U.S.C. §119(e) to U.S. Provisional Application No. 60/831,357, filed on Jul. 17, 2006, which are hereby incorporated by reference.

BACKGROUND OF THE INVENTION

1. Field of the Invention

At least one embodiment of the present invention relates generally to systems and methods for processing materials and, more particularly, to systems and methods for processing high purity materials, such as abrasive slurries.

2. Discussion of Related Art

High purity process materials are required, for example, in the pharmaceutical, cosmetic and semiconductor industries. In the semiconductor industry, blended process materials are typically prepared using production systems in which raw materials are introduced to a mixing subsystem. Precision is required to produce a batch of blended process materials that is acceptable for its intended application and to ensure batch-to-batch consistency. A batch is then typically further processed downstream, such as by undergoing a filtering operation or further mixing, prior to delivery to a tool.

In many applications, it is desirable to continuously supply blended process materials to a point of use. Standby units are typically employed to facilitate taking one or more process elements offline periodically for servicing. Even minor fluctuations in process parameters associated with such transitioning, however, may lead to significant disruption of the continuous delivery and/or quality of the high purity material. Detrimental pressure drops within the system, for example, may be of particular concern.

BRIEF SUMMARY OF THE INVENTION

In accordance with one or more embodiments, the invention relates generally to systems and methods for processing high purity materials.

In accordance with one or more embodiments, the invention relates to a method of processing high purity materials, comprising acts of introducing a flow of a first material to a first unit operation, monitoring an operational parameter of the first unit operation, charging a second unit operation with pressurized gas, purging the pressurized gas from the second unit operation, and diverting the flow of the first material to the second unit operation in response to the operational parameter of the first unit operation registering a threshold value.

In accordance with one or more embodiments, the invention further relates to a system for processing high purity materials, comprising a first material supply line, a first unit operation fluidly connected downstream of the first material supply line, a second unit operation fluidly connected downstream of the first material supply line, a first sensor disposed to detect an operational parameter of the first unit operation, a second sensor disposed to detect an operational parameter of the second unit operation, a pressurized gas supply line fluidly connected to the first unit operation and the second unit operation, an outlet fluidly connected to the first unit operation and the second unit operation, and a controller, in communication with the first sensor, the second sensor and the outlet. The controller is configured to generate a first control signal to charge the second unit operation with pressurized gas from the pressurized gas supply line, a second control signal to divert a flow of the first material from the first unit operation to the outlet via the second unit operation in response to the first sensor registering a threshold value, and a third control signal to direct the flow of the first material toward a tool via the second unit operation after the pressurized gas has been purged from the second unit operation.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which.

DETAILED DESCRIPTION OF THE INVENTION

Figure 1:
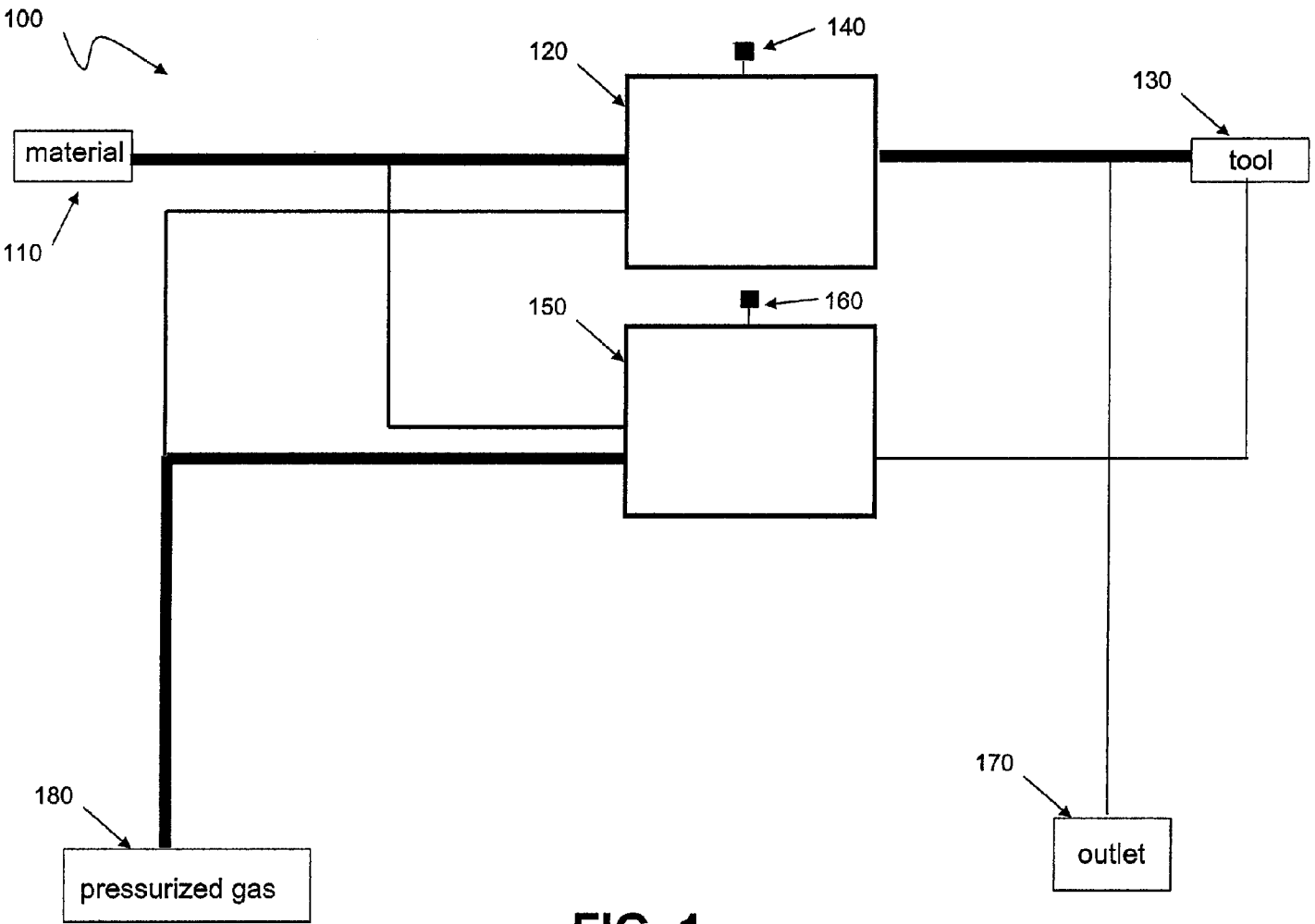
FIGS. 1-5 present schematic diagrams illustrating a system and various fluid flow patterns therein in accordance with one or more embodiments of the present invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to one or more systems and methods for processing high purity materials. The systems and methods described herein may be used, for example, in preparing materials with applications in a wide variety of industries including the cosmetic, pharmaceutical and semiconductor industries, as well as others in which there may be demand for a continuous and/or accurate supply of high purity materials.

Embodiments of the present invention may generally involve introducing a flow of a material to a unit operation. The unit operation may comprise any process component having a volume to be filled. The unit operation may be capable of acting upon the material, for example, by a combination, reaction or separation process. In some embodiments, the unit operation may involve a filter, such as a filter bank or system in which differential porosity filters can stage filter the material. The choice of filter and porosity may be determined based on the material to be processed and the intended application. Other unit operations may include, for example, an ion exchange bed, a grinder, a heater apparatus, or a cooler apparatus.

The unit operation may then direct the material downstream for further processing, storage or end use delivery. The material introduced to the unit operation may comprise any composition or mixture for which processing by the unit operation is desired, for example, a chemical mechanical planarization (CMP) slurry. The material may comprise a composition that has been processed, such as mixed or separated, upstream of the unit operation, or may comprise raw feed for initial processing by the unit operation. Some embodiments of the present invention may include multiple material streams introduced to multiple primary unit operations as discussed further below. For example, a first material supply line may be fluidly connected to a first unit operation while a second material supply line may be fluidly connected to a second unit operation. In some embodiments, the first and second unit operations may function simultaneously.

Systems of the present invention may further include one or more sensors capable of detecting, measuring and/or monitoring a property or operational parameter of a unit operation. The sensor may, for example, comprise one or more pressure sensors (e.g. pressure transducers) configured to monitor a pressure differential across a unit operation. A pressure differential may be measured directly, or based upon readings taken both upstream and downstream of the unit operation. Other operational parameters may include, for example, temperature, conductivity, flow rate, or power consumption. In some embodiments, the sensor may generate a signal based on collected data and may further communicate the signal to an operator of the system or to a controller. Information gathered by these sensors may, for example, aid in evaluating the performance of the unit operation and in assessing the maintenance requirements of the unit operation.

During operation of the system, it may be desirable or necessary to take a unit operation offline for servicing or maintenance. A unit operation may be serviced at regular intervals, or in response to an operational parameter registering a threshold value. For example, a pressure sensor in communication with a filter bank may register a differential pressure across the filter bank which is above a predetermined threshold value. The threshold value may vary among operators or based on an intended application. For example, if the differential pressure across a new or serviced unit operation registers 6 psi, then a differential pressure of 9 psi may be predetermined as the threshold value. Servicing may generally involve isolation of the unit operation as well as cleaning and/or replacing components of the unit operation. When the unit operation comprises a filter, for example, servicing may more specifically involve flushing, backwashing, or other cleaning regimes commonly known to those in the art.

A system in accordance with one or more embodiments of the present invention may also include one or more secondary unit operations to backup and/or support the primary unit operations in order to facilitate continuous processing and/or delivery of material downstream. Such secondary unit operations may be referred to herein as standby units or backup units. When a primary unit operation is taken offline for servicing or maintenance, flow of the material to be processed may be temporarily diverted to a standby unit, to prevent interrupting downstream delivery of processed material, until flow to the primary unit operation is restored. In general, the standby unit may be functionally identical to, and/or otherwise capable of replacing, the primary unit operation which it supports. According to some embodiments, a single standby unit may support one or more primary unit operations.

One or more embodiments of the present invention may further include features for reducing line pressure variations within the system. It may be desirable to prevent a line pressure drop in an active unit when transitioning between a primary unit operation and a standby unit operation, such as for servicing discussed above. Without wishing to be bound to any particular theory, a variation in line pressure may detrimentally impact the accuracy and/or continuity in the processing and delivery of high purity materials where precision is important.

Thus, in accordance with one or more embodiments of the present invention, the primary and secondary unit operations may be fluidly connected to a source of a pressurized fluid, such as a pressurized gas, to enable priming before transitioning between the unit operations. More specifically, a unit operation to be brought online can first be charged with a pressurized gas in order to achieve system pressure. The pressurized gas utilized may comprise any gas that is compatible with components of the system, for example, pressurized nitrogen gas. As discussed in greater detail below with reference to the various figures, the flow of material to be processed can then be temporarily diverted to the primed standby unit operation without experiencing a significant drop in line pressure.

The system may also include an outlet fluidly connected to each of the unit operations to facilitate purging the pressurized gas from the system as desired. One or more features of the system, such as various valves (e.g. needle valves) associated with flow lines within the system, may be adjusted and/or preset to restrict and/or control the rate at which pressurized gas is expelled from a unit operation. The rate at which material to be processed displaces pressurized gas in a unit operation may be controlled to aid in preventing line pressure variation during transitioning between unit operations. Regulating the rate at which the pressurized gas is expelled from a unit operation may directly control the inflow of material for processing.

Operation of at least one embodiment of the present invention will now be described in greater detail with reference to the accompanying drawings in which bold lines indicate fluid flow within the system.

Figure 2:
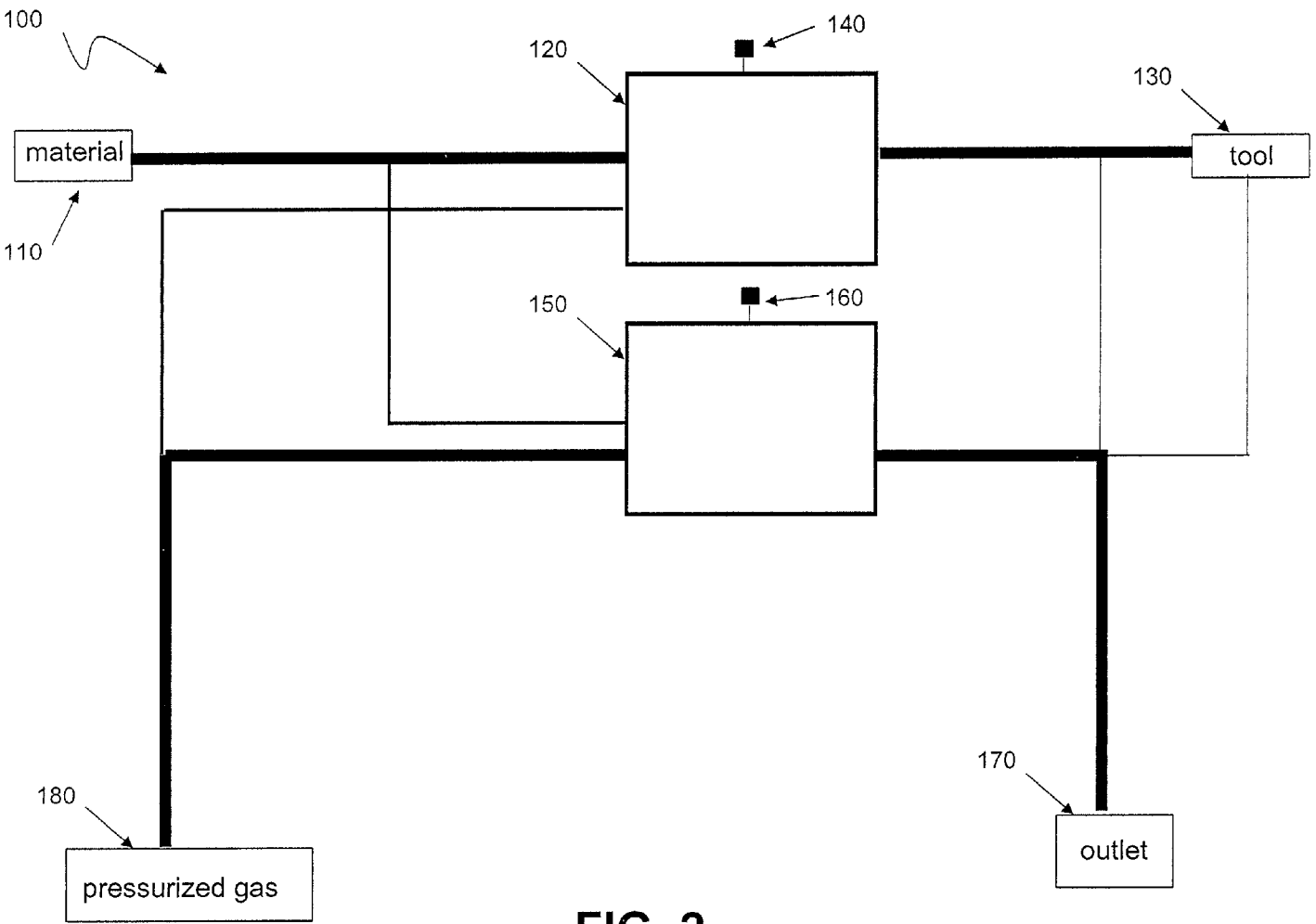

FIGS. 1 through 5 illustrate a system in accordance with one or more embodiments of the present invention. Flow of a material to be processed is introduced from a material supply 110 to a first unit operation 120. Processed material exiting the first unit operation 120 is directed downstream toward a tool 130 or for further processing. Alternatively, processed material exiting the first unit operation 120 may, for example, feed a semiconductor fabrication line. An operational parameter of the first unit operation 120 is monitored with a sensor 140, such as a differential pressure sensor. Additional sensors may be provided before and after the first unit operation 120 (e.g. in supply and outlet lines). As illustrated in FIG. 1, a second unit operation 150 is charged with pressurized gas from a pressurized gas source 180 to achieve system pressure. This priming action may occur while the first unit operation 120 is actively processing material. The pressurized gas may either be retained within the second unit operation 150, as in FIG. 1, or may be continually vented from the system 100 via outlet 170 as illustrated in FIG. 2.

Figure 3:
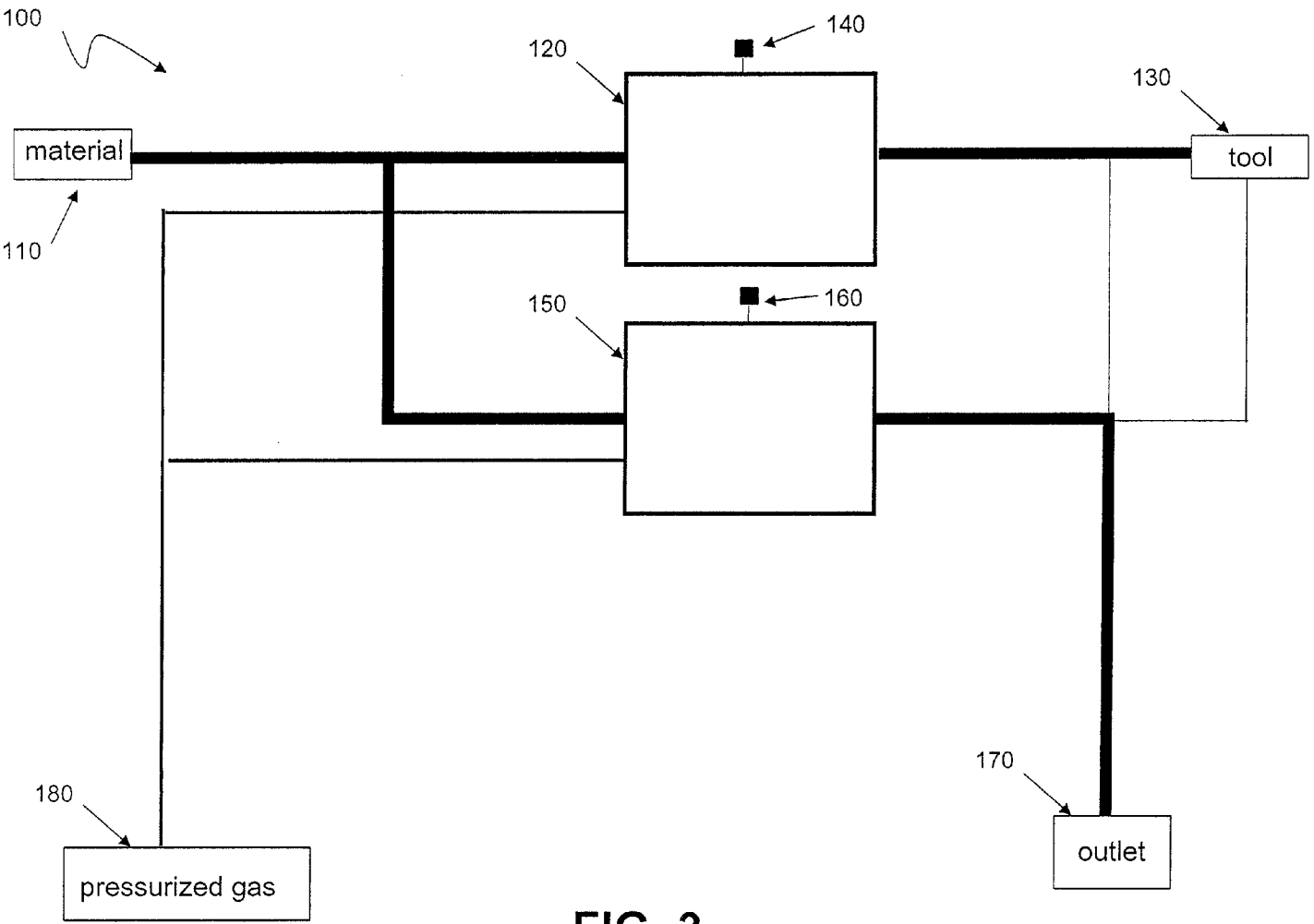
Figure 4:
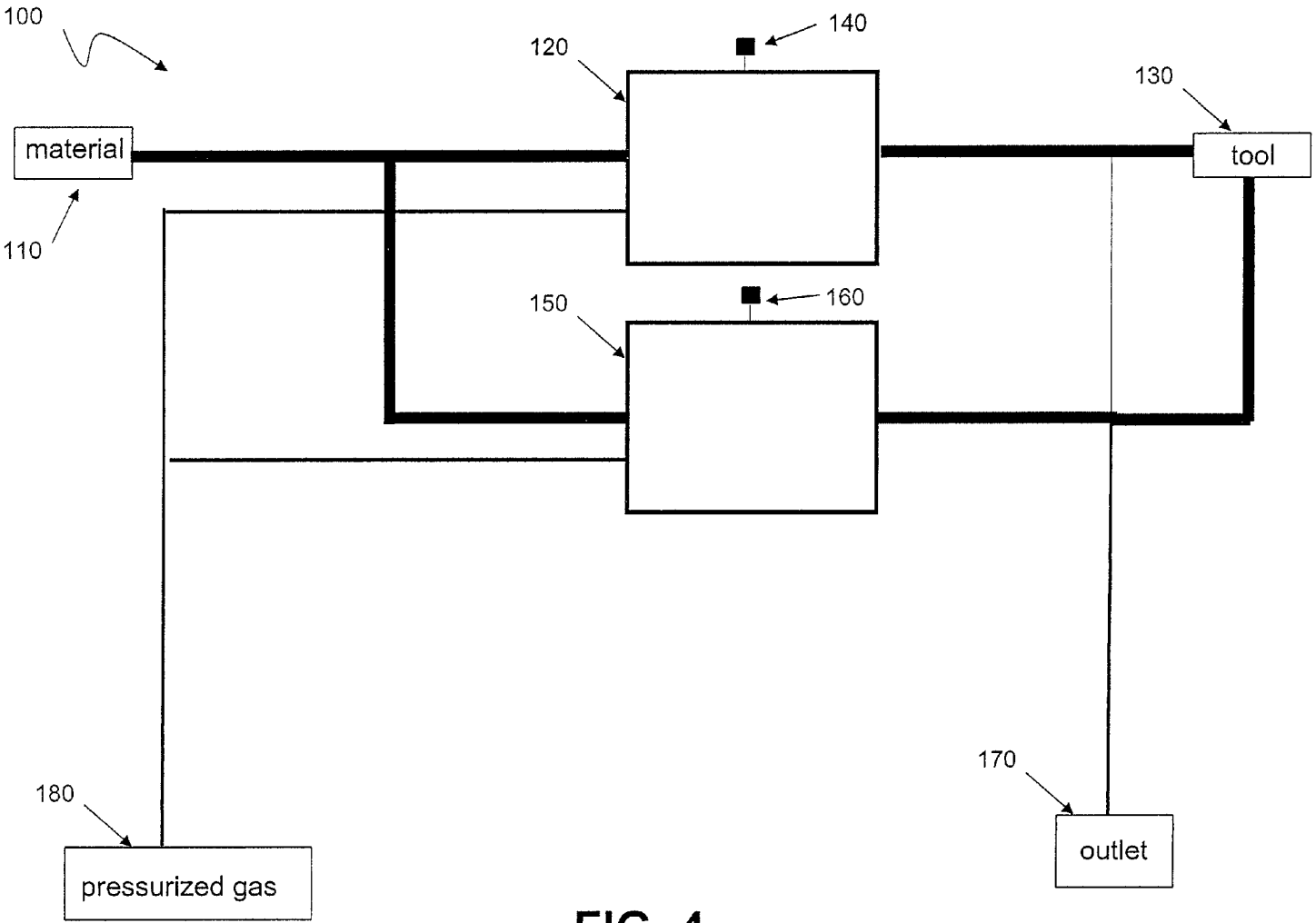
Figure 5:
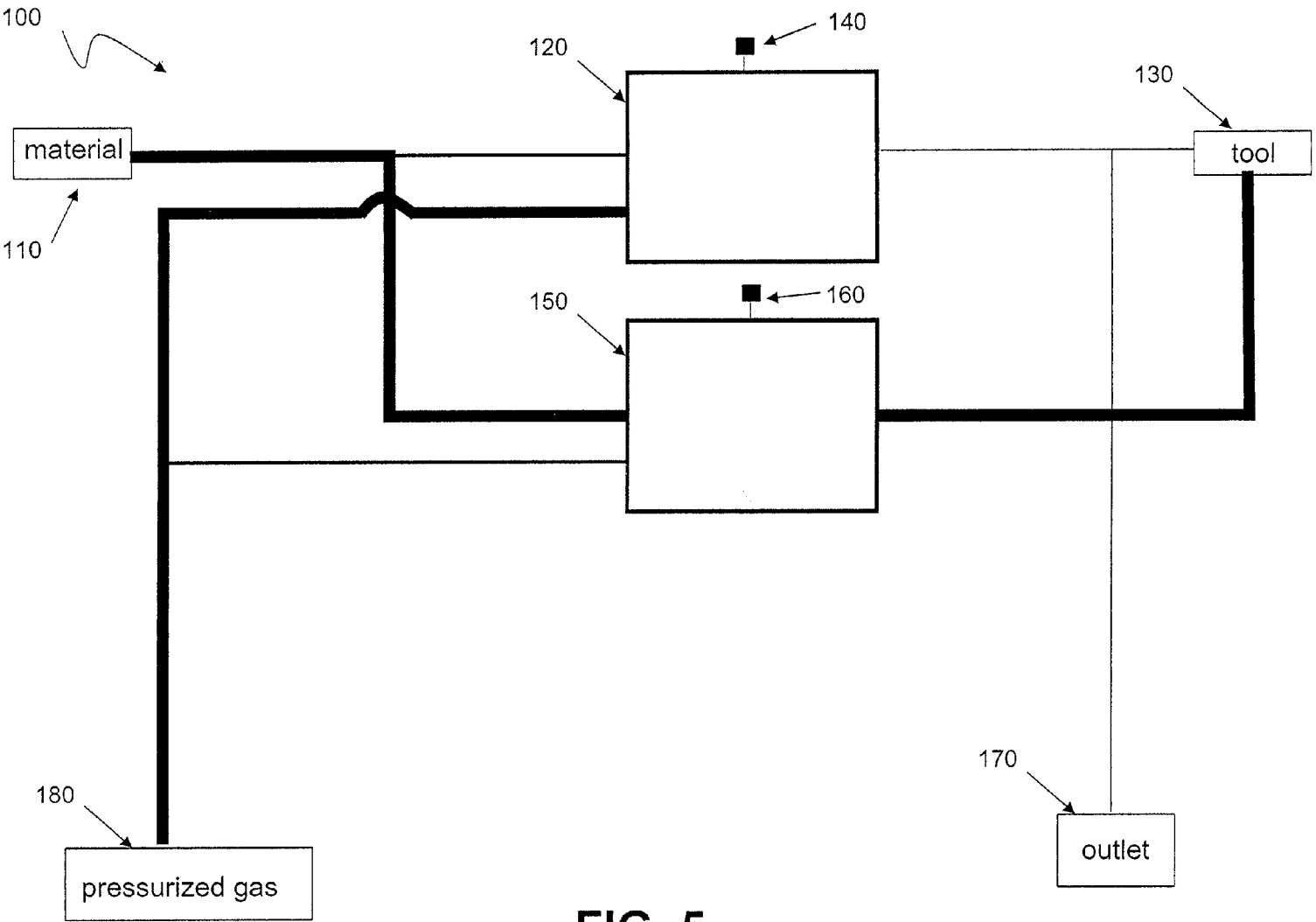

According to one or more embodiments, a transition between unit operations may be initiated in response to the operational parameter of the first unit operation 120 registering a predetermined threshold value as detected by the sensor 140. Alternatively, the transition may occur periodically, intermittently or at predetermined time intervals as determined by an operator of the system 100. During the transition, material from the material supply 110 may first be introduced to both the first and the second unit operations 120, 150 for processing. FIG. 3 illustrates this period of dual operation during which flow exiting the second unit operation 150 is vented via outlet 170 to purge the pressurized gas from the system 100. Once the pressurized gas is sufficiently expelled, flow exiting the second unit operation 150 is then directed toward the tool 130 as presented in FIG. 4. Material flow can then be completely diverted from the first unit operation 120 to the second unit operation 150 as illustrated in FIG. 5. The described changeover between the first unit operation 120 and the second unit operation 150 may be accomplished without interrupting continuous downstream delivery of processed material, and without a significant drop in line pressure, for example, less than 1 psig. The second unit operation 150 may be brought online while avoiding a pressure transient in the first unit operation 120.

An operational parameter of the second unit operation 150 is monitored with a second sensor 160. While the second unit operation 150 is online processing the material as a backup support unit, the first unit operation 120 can be serviced. For example, the first unit operation 120 may be fluidly isolated from the remainder of the system 100, and components thereof may be cleaned and/or replaced. In this way, the operational parameter of the first unit operation 120 may be restored to below the threshold value.

After maintenance, the first unit operation 120 is then prepared to be placed back online while the second unit operation 150 is still operating. The first unit operation 120 may be charged with pressurized gas from pressurized gas source 180. Again, the pressurized gas may be either retained within the first unit operation 120 as illustrated in FIG. 5, or may be continuously vented via the outlet 170.

Flow of material to be processed from the material supply 110 may then be restored to the first unit operation 120. Transition back to the first unit operation 120 may occur upon completing servicing and pressurization of the first unit operation 120. Alternatively, transition may proceed in response to the monitored operational parameter of the second unit operation 150 registering a second predetermined threshold value, for example, indicating that the second unit operation 150 requires servicing. Switchover or transition from the second unit operation 150 back to the first unit operation 120 may occur in like manner to the initial transition. For example, material may be introduced to both the first and second unit operations 120, 150, flow exiting the first unit operation 120 may be vented via the outlet 170 and later directed toward the tool 130 when the pressurized gas has been purged, and then the flow of material may be completely diverted from the second unit operation 150 to the first unit operation 120. The operational parameter of the first unit operation 120 may be monitored, and the second unit operation 150 may be serviced and primed to later be brought back online as required. During the process cycle described herein, an inactive unit operation is generally serviced and/or brought up to system operating parameters.

Figure 6:
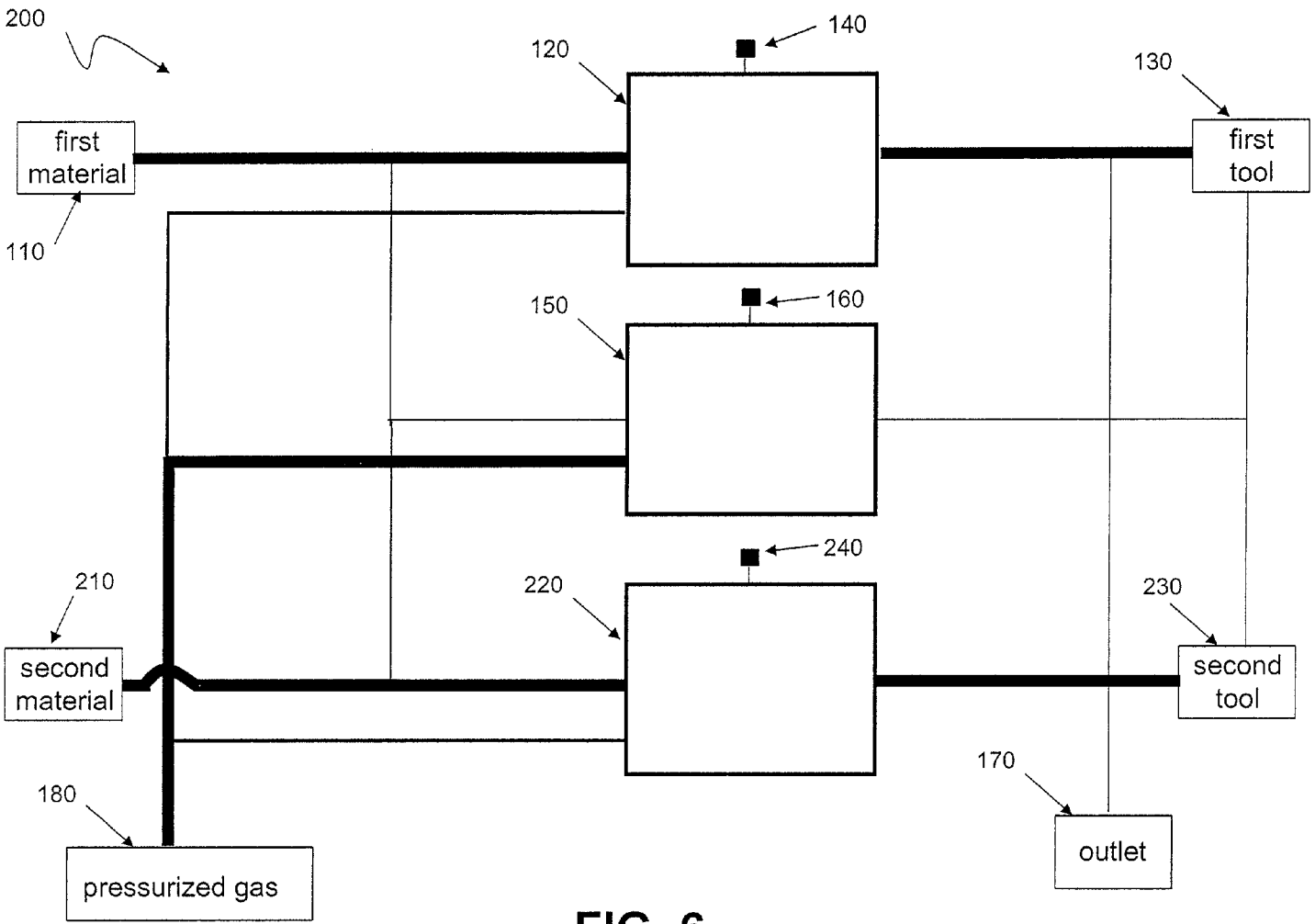
FIGS. 6-7 present schematic diagrams illustrating an alternative system and various fluid flow patterns therein in accordance with one or more embodiments of the present invention.
Figure 7:
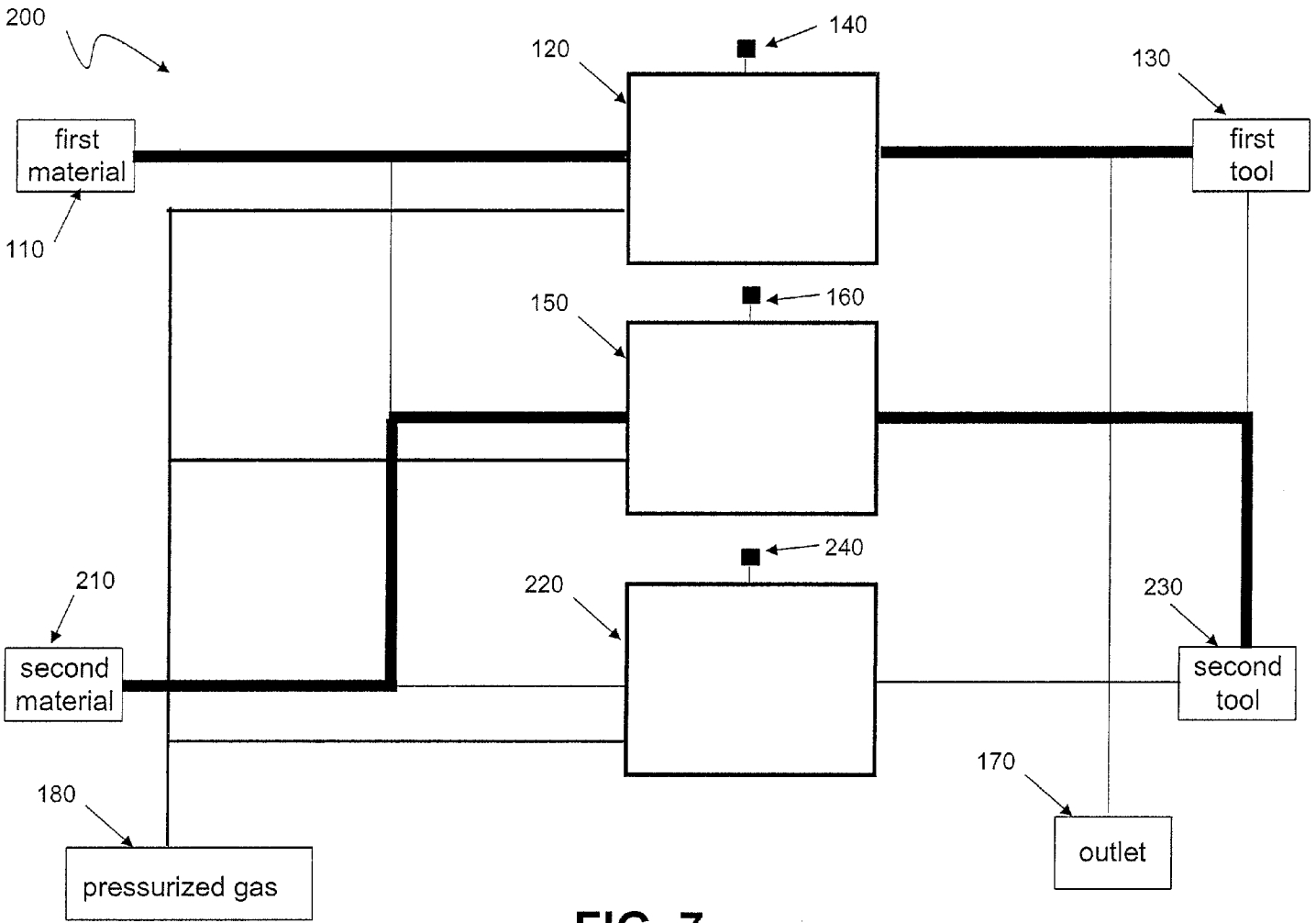

An alternative system 200 may further include a third unit operation 220 fluidly connected downstream of a second material supply 210 and the pressurized gas source 180, as illustrated in FIGS. 6 and 7. The first and second material supplies 110, 210 may comprise the same material and/or may originate from the same source. A third sensor 240 monitors an operational parameter of the third unit operation 220.

Flow exiting the third unit operation 220 may be delivered downstream to a second tool 230. According to one or more embodiments, the second unit operation 150 may be fluidly connected to both the first and second material supplies 110, 210, as well as to both the first and second tools 130, 230, in order to function as a standby or backup unit for both the first and third unit operations 120, 220. The first and second tools 130, 230 may be the same or different tools. In one embodiment, the first and third unit operations 120, 220 both feed a single semiconductor fabrication line.

During operation of the system 200, the first unit operation 120 may primarily function simultaneously with the third unit operation 220. Either of the first or second material supplies 110, 210 may be temporarily diverted to the second unit operation 150 in order to service one of the first and third unit operations 120, 220 respectively. Thus, the second unit operation 150 may function simultaneously with either of the first or third unit operations 120, 220 during a transition for servicing of one of the primary unit operations. Switchover or transition between unit operations may proceed as discussed above with respect to the system 100 according to FIGS. 1 through 5 in order to minimize detrimental line pressure variations. For example, an inactive unit operation may be charged with pressurized gas to achieve system pressure before bringing it online, and flow exiting an active unit operation may be purged of pressurized gas via an outlet before being directed to a tool, storage or other point of use. In embodiments with two or more primary units, switchover may also proceed without overlapping operation of units in transition, such as through complete initial diversion of material, while still maintaining continuous delivery downstream.

As exemplarily illustrated in FIG. 6, the first and third unit operations 120, 220 may operate simultaneously to process materials from the first and second material supplies 110, 210 respectively. The second unit operation 150 is temporarily offline and functioning as a standby unit. As illustrated, the second unit operation 150 is being charged with pressurized gas from the pressurized gas source 180 to achieve system pressure. Again, the pressurized gas may be retained within the second unit operation 150 as shown, or alternatively, may be continuously vented via the outlet 170. Operational parameters of the first and third unit operations 120, 220 are being monitored via the sensors 140, 240 respectively to, for example, aid in determining whether one or both should be taken offline for maintenance.

FIG. 7 illustrates the same system but with flow of the second material supply 210 temporarily diverted from the third unit operation 220 to the second unit operation 150 in response to the third sensor 240 registering a threshold value. The third unit operation 220 has been isolated for servicing and will likewise be charged with pressurized gas to achieve system pressure. The third unit operation 220 may be brought online in response to an operational parameter of the second unit operation registering a threshold value, or, alternatively, upon completion of servicing and priming of the third unit operation 220.

In some applications, downstream demand for processed material may diminish or halt at times. Without wishing to be bound to any particular theory, recirculating material through a unit operation, such as recirculating an abrasive slurry through a filter, may be harmful to the slurry and/or to the performance of the unit operation. In these situations, it is envisioned that a stream of material may be diverted to a bypass loop, without an associated unit operation, until downstream demand resumes. In order to prevent line pressure variation, the bypass loop may be charged with pressurized gas before being brought online in accordance with the methods discussed above with respect to standby unit operations.

The disclosed methods of processing high purity materials may be performed manually or implemented automatically through use of a controller incorporated into the system. For example, the system may include a controller in communication with the sensors and various valves associated with flow to the unit operations, tools, and the outlet. The controller may be configured to generate a first control signal to charge the second unit operation with pressurized gas from the pressurized gas supply line, a second control signal to divert a flow of the first material from the first unit operation to the outlet via the second unit operation in response to the first sensor registering a threshold value, and a third control signal to direct the flow of the first material toward a tool via the second unit operation after the pressurized gas has been purged from the second unit operation. The controller may be further configured to generate a fourth control signal to divert a flow of the second material from the third unit operation to the second unit operation in response to the third sensor registering a second threshold value. The controller may be further configured to isolate the first unit operation for servicing and to resume the flow of the first material to the first unit operation in response to the second sensor registering a third threshold value or in response to the first sensor registering below the threshold value.

The controller may be implemented using one or more computer systems, for example, a general-purpose computer such as those based on an Intel PENTIUM®-type processor, a Motorola PowerPC® processor, a Sun UltraSPARC® processor, a Hewlett-Packard PA-RISC® processor, or any other type of processor or combinations thereof. Alternatively, the computer system may include specially-programmed, special-purpose hardware, for example, an application-specific integrated circuit (ASIC) or controllers intended for material processing systems.

The computer system can include one or more processors typically connected to one or more memory devices, which can comprise, for example, any one or more of a disk drive memory, a flash memory device, a RAM memory device, or other device for storing data. The memory is typically used for storing programs and data during operation of a material processing system and/or the computer system. For example, the memory may be used for storing historical data relating to parameters over a period of time, as well as operating data. Software, including programming code that implements embodiments of the invention, can be stored on a computer readable and/or writeable nonvolatile recording medium, and then typically copied into the memory wherein it can then be executed by the processor. Such programming code may be written in any of a plurality of programming languages, for example, Java, Visual Basic, C, C#, or C++, Fortran, Pascal, Eiffel, Basic, COBAL, or any of a variety of combinations thereof.

Components of the computer system may be coupled by one or more interconnection mechanisms, which may include one or more busses (e.g., between components that are integrated within a same device) and/or a network (e.g., between components that reside on separate discrete devices). The interconnection mechanism typically enables communications (e.g., data, instructions) to be exchanged between components of the computer system.

The computer system can also include one or more input devices, for example, a keyboard, mouse, trackball, microphone, touch screen, and other man-machine interface devices as well as one or more output devices, for example, a printing device, display screen, or loudspeaker. In addition, the computer system may contain one or more interfaces (not shown) that can connect the computer system to a communication network (in addition or as an alternative to the network that may be formed by one or more of the components of the computer system).

According to one or more embodiments of the invention, the one or more input devices may include sensors for measuring parameters of a material processing system and/or components thereof. Alternatively, the sensors, the metering valves and/or other components, may be connected to a communication network that is operatively coupled to the computer system. Any one or more of the above may be coupled to another computer system or component to communicate with the computer system over one or more communication networks. Such a configuration permits any sensor or signal-generating device to be located at a significant distance from the computer system and/or allow any sensor to be located at a significant distance from any subsystem and/or the controller, while still providing data therebetween. Such communication mechanisms may be effected by utilizing any suitable technique including, but not limited to, those utilizing wireless protocols.

The controller can include one or more computer storage media such as readable and/or writeable nonvolatile recording medium in which signals can be stored that define a program to be executed by one or more processors. The medium may, for example, be a disk or flash memory. In typical operation, the processor can cause data, such as code that implements one or more embodiments of the invention, to be read from the storage medium into a memory that allows for faster access to the information by the one or more processors than does the medium. The memory is typically a volatile, random access memory such as a dynamic random access memory (DRAM) or static memory (SRAM) or other suitable devices that facilitates information transfer to and from the processor.

It should be appreciated that the invention is not limited to being implemented in software, or on the computer system as exemplarily discussed herein. Indeed, rather than implemented on, for example, a general purpose computer system, the controller, or components or subsections thereof, may alternatively be implemented as a dedicated system or as a dedicated programmable logic controller (PLC) or in a distributed control system. Further, it should be appreciated that one or more features or aspects of the invention may be implemented in software, hardware or firmware, or any combination thereof. For example, one or more segments of an algorithm executable by controller can be performed in separate computers, which in turn, can be communicated through one or more networks.

Other embodiments of the systems and methods of the present invention are envisioned beyond those exemplarily described herein.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is:

1. A method of processing high purity materials, comprising acts of:

introducing a flow of a first material to a first unit operation;

monitoring an operational parameter of the first unit operation;

charging a second unit operation with pressurized gas;

purging the pressurized gas from the second unit operation;

diverting at least a portion of the flow of the first material to the second unit operation in response to the operational parameter of the first unit operation registering a threshold value; and introducing a flow of a second material to a third unit operation and monitoring an operational parameter of the third unit operation.

2. The method of claim 1, further comprising diverting the flow of the second material to the second unit operation in response to the operational parameter of the third unit operation registering a second threshold value.

3. The method of claim 2, further comprising restoring the operational parameter of the third unit operation to below the second threshold value.

4. The method of claim 3, further comprising resuming the flow of the second material to the third unit operation.

5. The method of claim 1, wherein the first unit operation and the third unit operation function simultaneously.

6. A system for processing high purity materials, comprising:

a first material supply line;

a first unit operation fluidly connected downstream of the first material supply line;

a second unit operation fluidly connected downstream of the first material supply line;

a first sensor disposed to detect an operational parameter of the first unit operation;

a second sensor disposed to detect an operational parameter of the second unit operation;

a pressurized gas supply line fluidly connected to the first unit operation and the second unit operation;

an outlet fluidly connected to the first unit operation and the second unit operation;

a controller, in communication with the first sensor, the second sensor and the outlet, configured to generate a first control signal to charge the second unit operation with pressurized gas from the pressurized gas supply line, a second control signal to divert a flow of the first material to the second unit operation in response to the first sensor registering a threshold value, and a third control signal to direct the flow of the first material toward a tool via the second unit operation after the pressurized gas has been purged from the second unit operation; and a second material supply line fluidly connected upstream of the second unit operation.

7. The system of claim 6, wherein the first sensor comprises a pressure differential sensor.

8. The system of claim 6, wherein the first and second unit operations comprise filters.

9. The system of claim 6, further comprising a third unit operation fluidly connected downstream of the second material supply line.

10. The system of claim 9, further comprising a third sensor disposed to detect an operational parameter of the third unit operation.

11. The system of claim 9, wherein the controller is further configured to generate a fourth control signal to divert a flow of the second material from the third unit operation to the second unit operation in response to the third sensor registering a second threshold value.

12. The system of claim 9, wherein the first and third unit operations are configured to function simultaneously.

13. A method of processing flowing materials, comprising acts of:

providing a first flow of a first material to a first unit operation, the first flow of the first material provided at an operating pressure, the operating pressure predetermined to be set at a level for processing the first material;

priming a second unit operation to receive a second flow of the first material including providing a flow of a fluid to the second unit operation until the fluid in the second unit operation reaches a pressure at about the operating pressure; and providing the second flow of the first material to the second unit operation, from the first flow of the first material, at about the operating pressure, the flow of the first material to the second unit operation acting to purge the fluid in the second unit operation.

14. The method of claim 13, wherein the step of providing the second flow of the first material comprises diverting a portion of the first flow.

15. The method of claim 14, wherein the first flow of the first material and the second flow of the first material travel simultaneously to the first unit operation and to the second unit operation, respectively.

16. The method of claim 15, further comprising the first flow and the second flow traveling simultaneously at about the operating pressure through the first unit operation and through the second unit operation, respectively, to a system tool.

17. The method of claim 13, wherein the step of providing the second flow of the first material comprises diverting the first flow substantially entirely, including the second flow of the first material traveling through the second unit operation to a system tool at about the operating pressure.

18. The method of claim 17, further comprising priming the first unit operation to resume receiving the first flow of the first material including providing a flow of the fluid to the first unit operation until the fluid in the first unit operation reaches a pressure at about the operating pressure.

19. The method of claim 18, further comprising resuming the first flow of the first material to the first unit operation, including either diverting a portion of the second flow of the first material thereto or diverting substantially entirely the second flow of the first material thereto, and further comprising purging the fluid in the first unit operation.

20. The method of claim 13, further comprising the first material traveling through the first unit operation to a system tool at about the operating pressure.

21. The method of claim 17, further comprising flushing the first unit operation.

22. The method of claim 17, further comprising monitoring an operational parameter of the first unit operation, including detecting that the operational parameter has fallen below or exceeded a threshold value before the step of providing the second flow of the first material to the second unit operation.

23. The method of claim 22, further comprising modifying the first unit operation so that the operational parameter no longer falls below or exceeds the threshold value, respectively.

24. The method of claim 19, further comprising monitoring an operational parameter of the second unit operation, including detecting that the operational parameter of the second unit operation has fallen below or exceeded a threshold value before the step of resuming the first flow of the first material to the first unit operation.

25. The method of claim 22, wherein the operational parameter is selected from the group consisting of pressure differential, temperature, conductivity, flow rate, and power consumption.

26. The method of claim 17, wherein the step of the second flow of the first material traveling through the second unit operation to a system tool at about the operating pressure comprises regulating a rate of said purging the fluid in the second unit operation for controlling the second flow of the first material to the second unit operation to occur at about the operating pressure.

27. The method of claim 13, wherein the flow of the fluid to the second unit operation is a flow of a pressurized gas.

28. The method of claim 18, wherein the flow of the fluid to the first unit operation is a flow of a pressurized gas.

29. The method of claim 13, further comprising cleaning and flushing the second unit operation before the step of priming the second unit operation.

30. The method of claim 18, further comprising cleaning and flushing the first unit operation before the step of priming the first unit operation.

31. The method of claim 13, wherein the step of providing the second flow of the first material comprises diverting the first flow substantially entirely, and wherein said diverting the first flow substantially entirely occurs periodically, intermittently, or at predetermined time intervals.

32. A method of processing flowing materials comprising:

providing a first unit operation, a second unit operation, and a third unit operation;

providing a flow of a first material to the first unit operation at an operating pressure;

providing a flow of a second material to the third unit operation at about the operating pressure;

priming the second unit operation to receive either a diverted flow of the first material or a diverted flow of the second material, including providing a fluid to the second unit operation until the fluid in the second unit operation reaches a pressure at about the operating pressure.

33. The method of claim 32, further comprising diverting at least a portion of the flow of the second material to the second unit operation at about the operating pressure, including purging the fluid in the second unit operation.

34. The method of claim 33, wherein the flow of the first material and the diverted flow of the second material travel simultaneously to the first unit operation and to the second unit operation, respectively.

35. The method of claim 34, further comprising the flow of the first material traveling through the first unit operation to a first tool at about the operating pressure simultaneously with the diverted flow of the second material traveling through the second unit operation to a second tool at about the operating pressure.

36. The method of claim 33, wherein the step of diverting at least a portion of the flow of the second material comprises diverting substantially entirely the flow of the second material, and wherein the method further comprises priming the third unit operation to resume receiving the flow of the second material including providing the fluid to the third unit operation until the fluid in the third unit operation reaches a pressure at about the operating pressure.

37. The method of claim 36, further comprising resuming the flow of the second material to the third unit operation at about the operating pressure, including ending the diverted flow of the second material to the second unit operation, and further including purging the fluid in the third unit operation.

38. The method of claim 33, wherein the step of providing the flow of the first material to the first unit operation includes the first material traveling through the first unit operation to a first system tool at about the operating pressure simultaneously with the second material traveling through the third unit operation to a second system tool at about the operating pressure.

39. The method of claim 35, further comprising flushing the third unit operation.

40. The method of claim 36, further comprising monitoring an operational parameter of the third unit operation, including detecting that the operational parameter has fallen below or exceeded a threshold value before the step of diverting at least a portion of the flow of the second material.

41. The method of claim 40, further comprising modifying the third unit operation so that the operational parameter no longer falls below or exceeds the threshold value, respectively.

42. The method of claim 37, further comprising monitoring an operational parameter of the second unit operation, including detecting that the operational parameter of the second unit operation has fallen below or exceeded a threshold value before the step of resuming the flow of the second material to the third unit operation.

43. The method of claim 40, wherein the operational parameter is selected from the group consisting of pressure differential, temperature, conductivity, flow rate, and power consumption.

44. The method of claim 35, wherein the step of the diverted flow of the second material traveling through the second unit operation to a second tool at about the operating pressure comprises regulating a rate of said purging the fluid in the second unit operation for controlling the diverted flow of the second material to the second unit operation to occur at about the operating pressure.

45. The method of claim 33, wherein the fluid is a pressurized gas, and wherein the step of providing the fluid to the second unit operation comprises providing the pressurized gas to the second unit operation.

46. The method of claim 33, wherein the first material is substantially equivalent to the second material.

47. The method of claim 33, further comprising cleaning and flushing the second unit operation before the step of priming the second unit operation.

48. The method of claim 37, wherein the step of resuming the flow of the second material to the third unit operation at about the operating pressure comprises regulating a rate of said purging the fluid in the third unit operation for controlling the resumed flow of the second material to the third unit operation to occur at about the operating pressure.

49. The method of claim 42, wherein the operational parameter is selected from the group consisting of pressure differential, temperature, conductivity, flow rate, and power consumption.

50. The method of claim 36, further comprising cleaning and flushing the third unit operation before the step of priming the third unit operation.

51. The method of claim 36, wherein the fluid is a pressurized gas, and wherein the step of providing the fluid to the third unit operation comprises providing the pressurized gas to the third unit operation.

52. The method of claim 33, wherein the step of diverting at least a portion of the flow of the second material to the second unit operation occurs periodically, intermittently, or at predetermined time intervals.

53. A system for processing materials, comprising:

a first material supply line;

a fluid supply line;

a first unit operation fluidly connected downstream of the first material supply line and processing the first material at an operating pressure;

a second unit operation fluidly connected to the fluid supply line, and fluidly connected to the first material supply line for processing the first material at the operating pressure, the fluid supply line and the first material supply line both connected upstream of the second unit operation, the fluid supply line priming the second unit operation with fluid up to about the operating pressure;

a first sensor disposed to detect an operational parameter of the first unit operation; and a controller, in communication with the first sensor, configured to generate a first control signal to commence said priming the second unit operation with fluid up to about the operating pressure, a second control signal to divert a flow of the first material to the first unit operation to the second unit operation in response to the first sensor registering a threshold value.

54. The system of claim 53, further comprising:

a second material supply line, wherein the second unit operation is fluidly connected downstream of the second material supply line for processing the second material at the operating pressure; and a third unit operation fluidly connected downstream of the second material supply line and processing the second material at the operating pressure.

55. The system of claim 54, further comprising a second sensor in communication with the controller and disposed to detect an operational parameter of the third unit operation, wherein the controller is further configured to generate a control signal to divert a flow of the second material to the third unit operation to the second unit operation in response to the second sensor registering a second threshold value.

56. The system of claim 53, further comprising a tool fluidly connected downstream of the first unit operation and the second unit operation, wherein the controller is further configured to generate a control signal to direct the flow of the first material to the second unit operation to the tool.

57. The system of claim 55, further comprising a tool fluidly connected downstream of the second unit operation and the third unit operation, wherein the controller is further configured to generate a control signal to direct the flow of the second material to the second unit operation to the tool.

58. The system of claim 54, wherein the first unit operation and the third unit operation are configured to process, respectively, the first material and the second material simultaneously.

59. The system of claim 53, wherein the first unit operation is fluidly connected downstream of the fluid supply line and the controller is configured to generate a signal for priming the first unit operation with fluid up to about the operating pressure and a signal for redirecting the flow of the first material to the second unit operation to the first unit operation.

60. The system of claim 59, further comprising a second sensor in communication with the controller and disposed to detect an operational parameter of the second unit operation, wherein the controller generates the signal for priming the first unit operation and the signal for redirecting the flow of the first material to the first unit operation in response to the second sensor registering a second threshold value.

61. The system of claim 54, wherein the third unit operation is fluidly connected downstream of the fluid supply line and the controller is configured to generate a signal for priming the third unit operation with fluid up to about the operating pressure and a signal for redirecting the flow of the second material to the second unit operation to the third unit operation.

62. The system of claim 61, further comprising a second sensor in communication with the controller and disposed to detect an operational parameter of the second unit operation, wherein the controller generates the signal for priming the third unit operation and the signal for redirecting the flow of the second material to the third unit operation in response to the second sensor registering a second threshold value.

63. The system of claim 53, wherein the fluid supply line comprises a pressurized gas supply line.

64. The system of claim 59, further comprising an outlet connected to the first unit operation and to the second unit operation, the outlet comprising a valve for controlling a rate at which the fluid is expelled from the first unit operation and the second unit operation.

65. The system of claim 61, further comprising an outlet connected to the second unit operation and to the third unit operation, the outlet comprising a valve for controlling a rate at which the fluid is expelled from the second unit operation and the third unit operation.

* * * * *